United States Patent [19]

Lockert

[11] Patent Number: 5,049,030

[45] Date of Patent: Sep. 17, 1991

[54] MATERIALS HANDLING EQUIPMENT

[76] Inventor: Timothy L. Lockert, 3125 Cedarbrook Ln., Trussville, Ala. 35173

[21] Appl. No.: 374,543

[22] Filed: Jun. 30, 1989

[51] Int. Cl.[5] ..... B65H 29/36; B65H 3/08

[52] U.S. Cl. ..... 414/788.7; 414/793.5; 414/797; 271/194; 271/84; 271/267

[58] Field of Search ..... 414/788.4, 788.7, 793.4, 414/793.5, 794.3, 794.8, 796.7, 796.9, 797, 222, 225, 751, 752; 271/84, 194, 267

[56] References Cited

U.S. PATENT DOCUMENTS

| | | | |
|---|---|---|---|
| 2,217,983 | 10/1940 | Hopkins | 414/797 X |
| 3,148,780 | 9/1964 | Lindemann | 414/793.4 X |
| 3,311,372 | 3/1967 | Hall | 271/194 |
| 3,834,558 | 9/1974 | Bru | 414/797 X |
| 3,884,368 | 5/1975 | Ballard | 414/797 |
| 3,888,359 | 6/1975 | Moline | 271/194 X |
| 3,894,638 | 7/1975 | Hovekamp | 414/793.5 |
| 3,912,253 | 10/1975 | Jarman | 414/788.7 X |
| 4,473,922 | 10/1984 | Weihe | 414/788.7 X |
| 4,547,115 | 10/1985 | Charbonnet | 414/797 X |
| 4,565,478 | 1/1986 | Ericsson | 414/797 X |

FOREIGN PATENT DOCUMENTS

| | | | |
|---|---|---|---|
| 1093294 | 11/1960 | Fed. Rep. of Germany | 414/793.4 |
| 2054146 | 5/1972 | Fed. Rep. of Germany | 414/793.5 |
| 0039257 | 3/1977 | Japan | 414/793.4 |
| 0132236 | 10/1981 | Japan | 414/797 |
| 0093840 | 6/1982 | Japan | 414/797 |
| 1382548 | 3/1988 | U.S.S.R. | 414/797 |

*Primary Examiner*—Frank E. Werner
*Assistant Examiner*—John Vanden Bosche
*Attorney, Agent, or Firm*—Jennings, Carter, Thompson & Veal

[57] ABSTRACT

A material handling system employs a sheet separator capable of handling sheets of varied thickness and flexibility and a positioner which repetitively positions sheets relative to a pressing unit in a fixed location. A sheet stacker receives and stacks the processed sheets at a rate of up to five sheets per minute.

20 Claims, 7 Drawing Sheets

MATERIALS HANDLING EQUIPMENT

FIELD OF THE INVENTION

The present invention is related to material handling equipment and more particularly to material handling equipment adapted for handling large sheets of substantially rigid material. In greater particularity it may be noted that the present invention relates to material handling equipment of the type wherein large sheets of semi-rigid material such as thin sheets of metal or plastic may be unstacked, processed and restacked in an automated assembly line. Furthermore the present invention relates to such apparatus as may easily handle sheets of material which have a varied thickness or which are variable in resiliency. Also the present invention contemplates that the various components in a material handling system may be individually separable and usable as stand-alone units in conjunction with other material handling apparatus.

BACKGROUND OF THE INVENTION

Large sheet material is awkward to handle, especially when the material is thin and is of a large lateral and linear dimension. The large sheet material, besides being clumsy, is heavy and hard to hold while at the same time it is extremely vulnerable to being creased or permanently bent. Furthermore such material is susceptible to surface marring by virtue of handling apparatus. Therefore, it is desirable to maintain such material in stacked configurations such that only the upper and lower sheet are susceptible to surface marring. Accordingly, it has been known in the past to utilize material handling apparatus which unstacks sheets of the panel-like material, processes the material and restacks the sheets. It should be noted, however, that the prior art has failed to deal with the problem of sheet material of varying resiliency. That is to say, a sheet of material depending upon the type of material, has a certain resistance to bending transversely of its longitudinal axis. This resistance to bending varies depending upon the thickness of the material and the type of material, accordingly, apparatus which have heretofore to unstack such material have been designed with a particular resiliency in mind. Again, that is to say, the apparatus has been designed with limitations dictated by the type of material being handled.

In addition to the limitations of the prior art imposed at the unstacking station, the utilization of automated machinery to position large sheets of material for operations thereon by materials such as turret presses has been less than satisfactory. One problem associated with the prior art devices is the ability to accurately and repetitively align the machinery with the turret press such that the press may utilize the maximum area of the sheet for its operations. Yet another problem associated with such operations is the removal of processed sheets from the rotary press in a manner which will allow the sheets to be stacked in an orderly fashion. As is well known, normally such sheets have portions thereof removed proximal the leading and trailing margins, therefore it is difficult for grasping apparatus to securely grip the material and to propel the material along in an aligned condition.

Once a sheet of material has been properly punched, it is then also imperative that it be expeditiously removed from the punch area into a reformed stack. Prior apparatus have been successful in restacking material, however their rate of operation leaves something to be desired. One limitation seen in the prior art is the utilization of a disappearing roller table to support a sheet member instantaneously during the stacking operation. In the prior art such disappearing tables usually are movable in the direction of travel of the sheet member therefore the table must move to one end of the sheet to allow a sheet to descend and then reposition itself before a new sheet may be supported thereon. While such an arrangement is acceptable when a plurality of sheets are to be stacked atop the disappearing table, when each sheet must be individually handled by the disappearing table, it is clear that the time required for this type operation is excessive.

SUMMARY OF THE INVENTION

It is the object of the present invention to provide a materials handling system wherein the sheet unstacker is capable of handling materials of various dimensions and flexibility or thicknesses.

Yet another object of the invention is to provide a materials handling apparatus for sheet-like materials wherein damaged or unsuitable sheet-like members may be rejected prior to the processing thereof.

Still another object of the invention is to provide a materials handling apparatus which allows the materials to unstacked, positioned, processed and restacked without marring the surface thereof.

Still another object of the invention is to provide a materials handling apparatus wherein sheet-like materials may be accurately positioned for processing by such apparatus as a turret press.

Yet another object of the invention is to provide a materials handling apparatus wherein large sheet-like members may be unstacked, processed, and restacked efficiently.

Other features and objects and advantages of the present invention will become apparent from a reading of the following description as well as a study of the appended drawings.

The apparatus may be briefly described as a sheet separating unit which feeds a sheet positioning unit which in turn positions the sheet for work on a processing unit which in turn passes the sheet to a sheet stacker. The processing unit as hereinafter described is described as a turret type punch press, however, the particular processing unit is not a portion of this invention and is included in the description only for illustrative purposes. The components which are considered to be inventive are the sheet separator, the positioner and the sheet stacker, taken alone and in combination. The sheet separator utilizes a technique of bending the sheet prior to lifting the entire sheet from a stack of sheets which is positioned on a constant leveling table as is well known in the art. It has been heretofore known to lift sheets in a manner similar to the present invention wherein the leading edge of the sheet is raised causing a deflection of the sheet to overcome the vacuum or surface cohesions existing between the sheets to prevent the inadvertent lifting of more than one sheet at a time. However, the prior art has remained silent on the method or apparatus whereby the thickness of the sheet is not a determinative factor in the design of the apparatus. That is to say, the prior art has designed machinery for a specific type of sheet-like member and each thickness or each variation in flexibility of the sheets required a reconstruction of the machine. In the present invention, vacuum cups are used as the means for attachment to the upper surface of the uppermost sheet of sheet-like material in a stack in as much as it has been determined that magnetic pick-up elements can have detrimental effects on the properties of the sheet material. The present invention utilizes a forward vacuum head comprising a plurality of vacuum cups aligned transversely to the linear longitudinal dimension of the sheet-like material and supported on a movable vacuum head. Each vacuum cup in the array is pivotally mounted such that it enjoys a large degree of freedom of movement during engagement with the surface of the sheet-like material. Also, the array of vacuum cups are mounted on a front assembly which allows the cups to be deflected slightly forwardly or rearwardly during the pick-up process. The entire cup assembly is mounted to a movable carriage which has mounted thereto a second array of vacuum cups which may be displaced incrementally from the first array of vacuum cups and is aligned parallel thereto and engages the upper surface of a sheet of material at a selected distance from the first array of cups. It should be appreciated by those familiar with the art that a sheet of material is difficult to lift directly vertically due to the vacuum created between the sheets or the surface cohesion as it is sometimes called. Therefore the forward vacuum cup assembly is independently operable of the rear vacuum assembly and can be engaged with the surface of the sheet-like material to lift the forward edge of the sheetlike material from the stack while the rear vacuum cup assembly holds the rear of the sheet against the stack. By lifting the forward edge of the stack, the vacuum and surface cohesion problems are overcome and the entire sheet may be easily lifted from the stack and separated from a subjacent sheet. To accommodate the variation in the angular orientation of the cups, it is noted that the present invention employs swivel mounted cups and a linear bearing mount to allow some movement in the longitudinal direction. When the sheet-like member is raised by the suction cups it is thereafter supported on a disappearing type roller table and moved forwardly by the sheet separator carriage until it is engaged between a set of pinch rollers which serve as the discharge transport means. Upon engagement with the pinch rollers, the suction is released and the sheet member is urged onto a workplace, typically, a worktable for a turret type press. Upon entry of the sheetlike member on the workplace, an optical sensor recycles the sheet separator and initiates operation of a sheet positioner.

The sheet positioner utilizes a pair of overhung suction cups as gripping elements which attach themselves to the surface of the sheet-like member and continue to urge the sheet-like member in the direction of travel instituted by the pinch rollers. Continued movement of the sheet-like member by the positioner assembly uncovers a retractable pin formed in the worktable and an optical sensor adjacent the retractable pin which optical sensor initiates a control sequence whereby the positioner assembly is stopped and its direction of travel is reversed such that the sheet-like member is caused to abut against the now-extended retractable pin at the trailing edge of the sheet-like member. The sheet-like member, while being held against the retractable pin, is urged laterally by the positioner utilizing a set of independent fluidly operated arms supporting each vacuum cup, thus the sheet may be squared against a workholder of the type commonly employed on worktables with turret presses and thus the side of the sheet-like member and trailing edge of the sheet-like member are made to conform to a predetermined alignment. Alternatively, the sheet-like member is urged laterally against the workholder prior to abut ting the pin. Upon alignment of the sheet-like member in the workholder, the vacuum is released and the positioner assembly is pivoted upwards and outwardly away from the worktable to allow the turret mechanism of the turret press complete freedom of operation. The workholder on the worktable is capable of advancing the sheet-like material during and subsequent to operation of the turret press. As is well known in the utilization of workholders and turret presses, the workholder grasps the sheet-like material by the adjacent longitudinal side and the turret press leaves a marginal strip extending longitudinally along the gripped side to permit the workholder to function. This marginal strip constitutes wasted material which is unusable in the processing of the sheet-like material, however it does provide an opportunity to utilize our novel sheet stacker.

Our sheet stacker utilizes a movable workholder which engages the marginal portion of the sheet in the area normally wasted by a turret press as the sheet is discharged from the worktable. The workholder utilizes a pair of spaced apart gripper elements which grip the material in a manner that will prevent pivoting of the material as might be encountered by a single gripping element. The movable workholder then pulls the sheet off the worktable to a position superjacent a disappearing table configuration wherein the table is movable laterally, that is, perpendicular to the direction of travel and toward the workholder such that the sheet is partially supported by the table as it is moved by the workholder. When the workholder reaches a predetermined position, the table begins to retract to a position under the workholder and the workholder releases the sheet-like member into position atop a stack which is forming subjacent the table. The workholder then advances to completely free itself from the sheet-like material and upon reaching a full stop position retracts to receive the next piece of sheet-like material while the disappearing table completes its retraction to allow the discharged sheet-like member to rest atop the forming table and re-extends to accept the newly discharged sheet-like member which the workholder will subsequently bring into position above the disappearing table. Cycle times of approximately twelve seconds per sheet are achievable using this improved stacker.

BRIEF DESCRIPTION OF THE DRAWINGS

Apparatus embodying features of my invention are illustrated in the enclosed drawings which form a portion of this disclosure and wherein.

DESCRIPTION OF THE PREFERRED EMBODIMENTS

Figure 1:
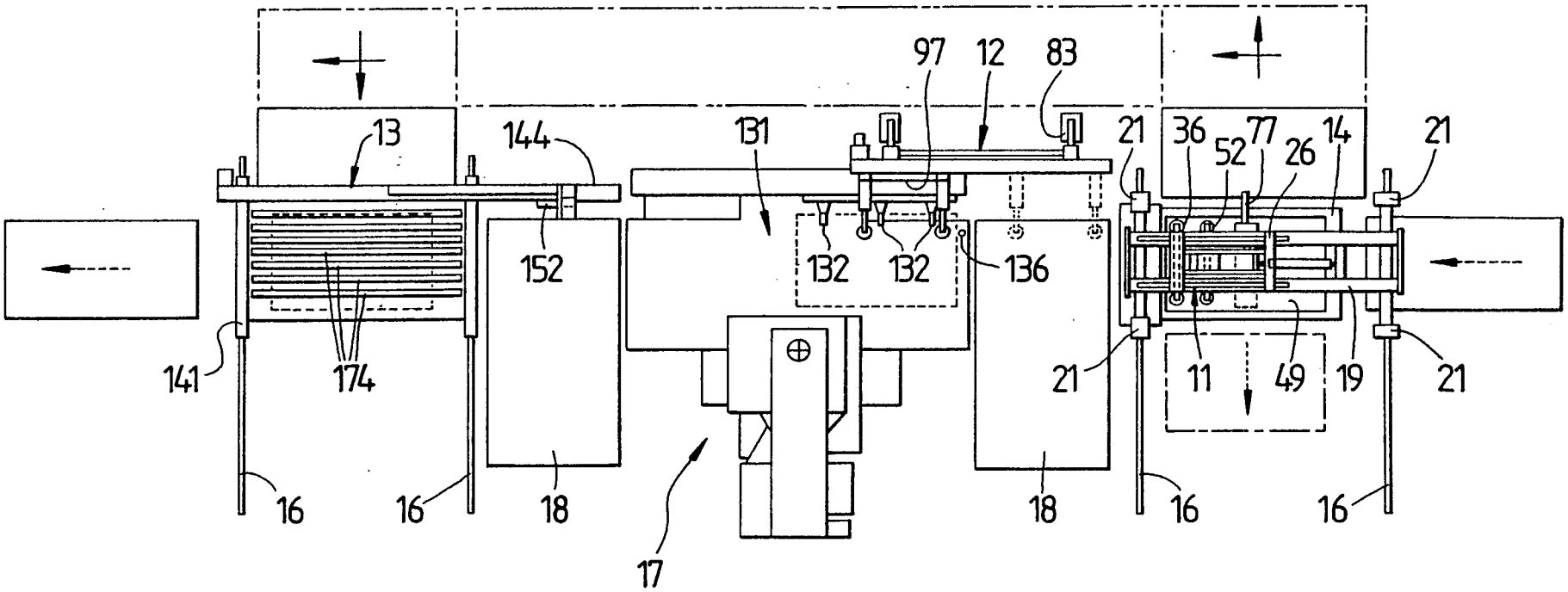
FIG. 1 is a plan view showing the entire materials handling system.
Figure 4:
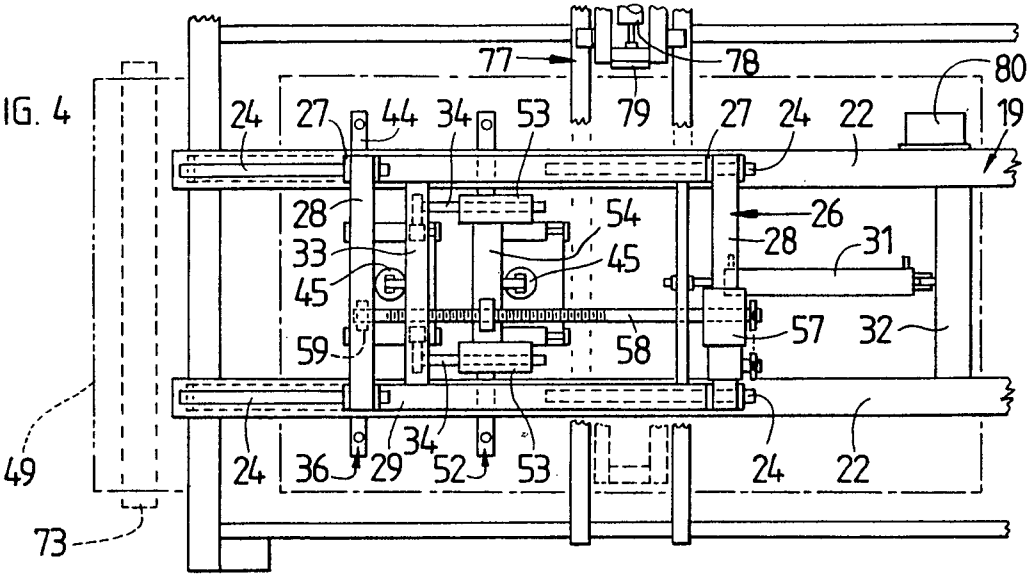
FIG. 4 is a plan view of the carriage mechanism of the sheet separator device.
Figure 2:
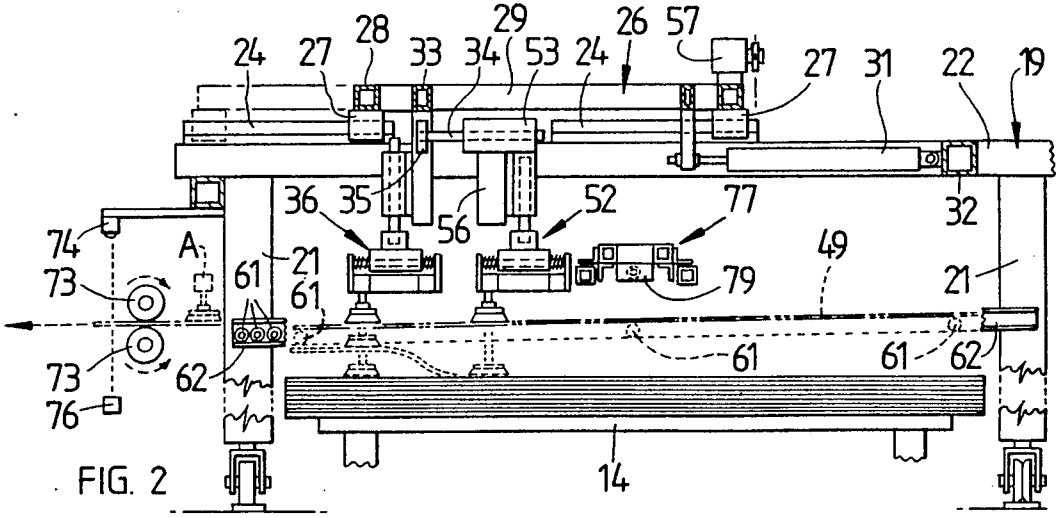
FIG. 2 is a side elevational view partially in section of the sheet separator mechanism.

Referring to the drawings for a better understanding of the principles of operation and structural subtleties of my invention, it will be seen that FIG. 1 shows an overall layout of the apparatus comprised in my invention which include a sheet separator indicated generally at 11, a positioner indicated generally at 12, and a stacker indicated generally at 13. It will be appreciated that there are other apparatus associated with my invention which are well known in the art and which may be considered to be typical components in a materials handling operation. For example, subjacent the sheet separator 11 is a constant height table indicated by numeral 14 which positions stacked sheets of material for separation and removal by the sheet separator. Likewise under sheet stacker 13 is Yet another constant height table 16 which receives the stacks of sheetlike material from my apparatus and causes the stack of material to remain at the same upper level. As best seen in FIG. 1, both the sheet separator 11 and the sheet stacker 13 are designed as movable component parts and are in fact located on a pair of rails 20 which allow the machine to be moved into and out of position. Accordingly, the placement of a pallet of material or removal of a pallet of material in stacked form is readily facilitated in my invention. Other apparatus shown in FIG. 1 which are associated with my invention but which do not form a portion of the invention include the turret punch press 17 and the worktable 18. However, it should be noted that the workplace of the press is modified by the use of a retractable locator pin as more completely set forth hereinafter. Referring to FIG. 2, it may be seen that the sheet separator utilizes a frame assembly 19 including a plurality of upright legs 21 and a plurality of horizontal members 22, the horizontal members forming an upper top-like structure which supports a pair of guide rods 24 to which are mounted a carriage assembly 26. The carriage assembly includes a set of guide followers 27 which slidably engage the guide rods 24 and allow the carriage to move reciprocally therealong. The guide followers in turn support a pair of cross members 28 which are affixed to a pair of longitudinally extending frame members 29. The entire carriage assembly is moved reciprocally along the guide bars 24 by the action of a linear actuator 31 which is connected to a frame bracket 32 supported between the longitudinal frame members 29. Also supported between the longitudinal frame members 29 is a vacuum head support bar 33 which supports a forward vacuum head and a pair of longitudinally extending guide rods 34. The forward vacuum head 36 may be more clearly understood by reference to FIG. 3 in addition to FIGS. 2, 2*a* and 4. The guide rods 34 are slidably affixed within tab members 35 which are supported on depending frame members 37 extending downwardly from the frame support bar 33. Also affixed to the vertical frame members 37 are a pair of vertically oriented guide bearings 38 which restrain therein a pair of guide rods 39. The guide rods 39 are attached to a vacuum head member 41 which extends parallel to support member 33 and has attached to the lower side thereof a set of linear bearings 42. The linear bearings contain therein a set of guide rods 43 which are spring biased to a predetermined position by coaxially mounted springs interposed between a pair of end brackets which support a depending structural element 44. A linear actuator 45is connected between the supporting element 33 and the vacuum head member 41 for purposes as are illustrated hereinafter. The depending structural element 44 is connected to a plurality of depending suction cups 46, each of which communicates with a controlled source of vacuum, not shown, through air lines 47 and each of which is individually pivotally mounted to said frame member 44.

Figure 2A:
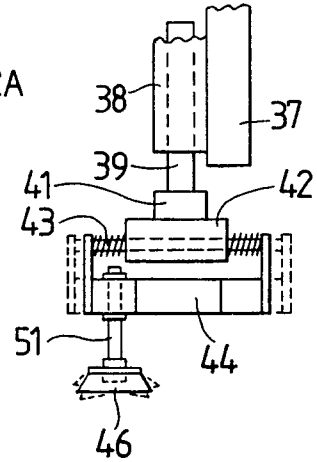
FIG. 2*a* is an enlarged detail view of one of the vacuum heads of the sheet separator mechanism.
Figure 3:
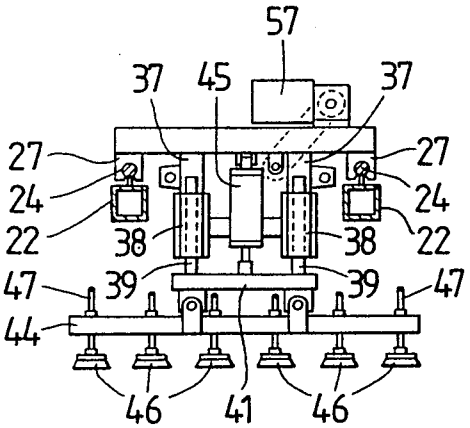
FIG. 3 is an end elevation of one of the vacuum heads of the sheet separator mechanism.

FIG. 2 includes representation of the vacuum cups 46 and sheet-like member 49 with the deflection of the sheetlike member 49 in a somewhat exaggerated state. Reference to FIG. 2*a* shows that the vacuum cups 46 are pivotally mounted at 49 to shafts 51 such that during operation of the apparatus the inclination of the cups 46 can conform to the inclination of the sheet surface. Likewise the spring loaded linear bearing assembly allows the cups 46 to move longitudinally slightly to accommodate changes in geometry as the front of the sheet is lifted by the forward lift assembly 36 while the remainder of the sheet is held down by the rear lift assembly 52.

The rear lift assembly 52 is slidably mounted on the guide rods 34 by a set of guide followers 53 which supports a crossmember 54 and a pair of vertical members 56. The vertical members 56 correspond to vertical member 37 of the front vacuum head assembly 36 and support a plurality of rear vacuum cups 55 in the same manner as vacuum cups 46 are supported. Note that supported on the carriage 26 is a motor 57 which drives a worm 58. The worm 58 engages a tab 59 on crossmember 54 and positions the rear lift assembly on the carriage relative to the forward lift assembly 36 by urging the rear lift assembly along the guide rods 34. Thus, the rear vacuum cups 55 may vary in displacement from the forward cups 46 by as much as 18 inches. This variable spacing between the cups permits the separator to handle materials of various thicknesses and flexibilities. For example, a spacing utilized with one thickness or flexibility may result in creasing or permanently defacing a sheet of material of a different thickness or flexibility, however, by varying the spacing between the cups the angle of deflection can be changed to prevent such occurrences.

It will be appreciated by those familiar with the art that lifting the forward edge prior to lifting the remainder of the sheet facilitates unstacking the topmost member without disturbing the subjacent member.

When the sheet has been so lifted, a plurality of transverse rollers 61 are displaced along a track 62 beneath the sheet and the carriage 26 is moved toward a set of pinch rollers 73 which are used to transport the sheet for further processing. As may be seen in FIG. 2, the cups 46 are displacable with the carriage to point A, whereat a sufficient length of the sheet 49 has been passed through the pinch roller to block the light from photo emitter 74 to detector 76. The detector provides a signal to a controller 80, such as a programmable computer which initiates the release of the vacuum from the cups 46 and return of the carriage 26 to its rest position. The linear actuators 45 which lowers the vacuum cups 46 and 55 are double acting actuators which retract to their initial position when the photo detector provides its signal. When the sheet is released by the vacuum cups, it is supported atop the transverse rollers 61 which are retracted when the trailing edge of the sheet passes beneath the photo sensor.

Also mounted on the frame 26 is a kicker assembly 77 which includes a linear actuator 78 and a sheet engaging angle 79 slidably mounted for movement transversely of said frame. This assembly is actuable to remove sheets laterally from atop the rollers 61 if a defect is noted in the sheet.

When a sheet is successfully passed through the transport means, it will be deposited on a work table 18 similar to the depiction in FIG. 1. At the work table the sheet must be properly positioned so that the processing device, such as a turret press 17, may operate on the sheet, for example utilize the maximum sheet area in stamping out articles. To properly position the sheet, I have devised my positioner assembly 12 which is more clearly depicted in FIGS. 5, 6, and 7.

Figures 5, 6, 7:
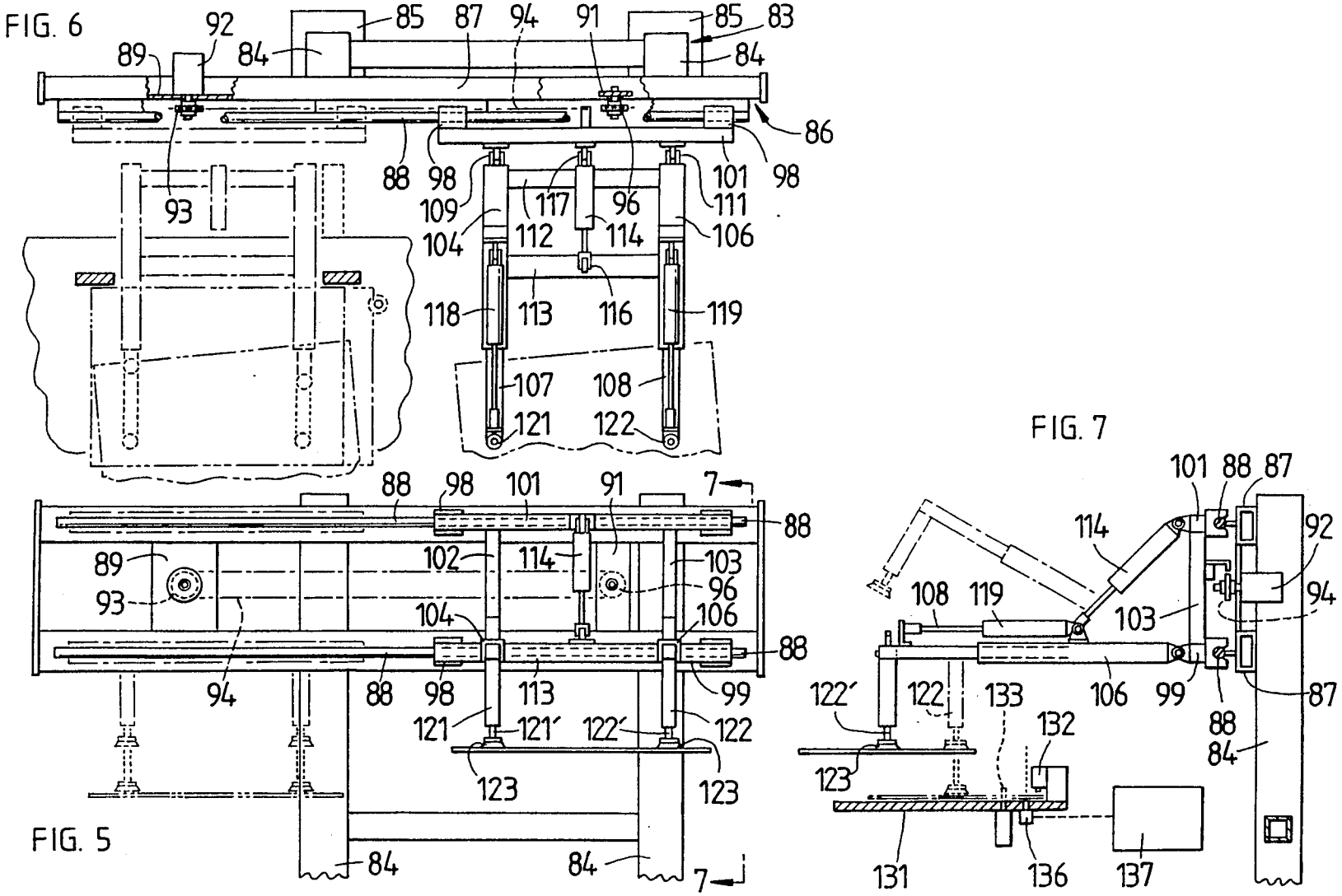
FIG. 5 is a side elevational view of the positioner device taken.
FIG. 6 is a plan view of the positioner device.
FIG. 7 is an end view taken along lines 7—7 of FIG. 5.

As seen in FIG. 5, the positioner assembly 12 includes a supporting frame 83 which has a pair of upright columns 84 mounted on spaced pedestals 85 and which support a carriage track 86. The carriage track 86 includes a pair of parallel horizontal beam members 87 which have mounted thereto a pair of parallel guide rods 88. Extending vertically between the beam members 87 are a motor mount plate 89 and a sprocket mounting plate 91.

A motor 92 having a drive sprocket 93 on its output shaft drives a chain 94 which extends around an idler sprocket 96 on sprocket mounting plate 91. Chain 94 is connected to a positioner carriage assembly 97 which includes guide followers 98 slidably supported on guide rods 88. Guide followers 98 support a pair of horizontally disposed assembly members 99 and 101 which are connected by vertical members 102 and 103. Extending horizontally from lower assembly member 99 are a pair of spaced apart arms 104 and 106 which include terminal portions 107 and 108 which are telescopingly slidable within the arms 104 and 106. Arms 104 and 106 are affixed to member 101 by means of a hinge connector 109 and 111 and are connected to each other by crossbraces 112 and 113. A linear actuator 114 is connected between crossbrace 113 and member 101 by hinge connection 116 and 117 such that arms 104 and 106 may be raised or lowered by the actuator 114. A pair of linear actuators 118 and 119 are mounted atop arms 104 and 106 and are affixed to terminal portions 107 and 108 to independently extend and retract the portions 107 and 108. Each portion 107 and 108 has a depending linear actuator 121 and 122 secured thereto and each depending linear actuator carries a vacuum cup 123 on the end of the associated piston rod 121' or 122'. From the foregoing it may be seen that the positioner carriage assembly moves laterally in a first direction of movement corresponding to the direction of movement of the sheets exiting the pinch roller and reverses direction to return to its initial position. The arm portions 107 and 108 are movable to the first direction of travel in a horizontal plane and the linear actuator 122 operates orthogonally to the carriage and the arms, thus the vacuum cups 123 are independently positionable relative to each other.

When a sheet of material is discharged by pinch roller 73 the vacuum cups 123 are positioned to engage the upper surface of the sheet and attach themselves thereto. Motor 92 is actuated to move the positioner carriage with the sheet held by the cups longitudinally from table 18 to the workplace 131 beneath the turret punch press. The workplace 131 for such a device usually includes a plurality of workholders 132 mounted along the sides thereof which clamp to the sheet-like material along a margin thereof and hold the sheet in position or move the sheet longitudinally beneath the punch press. In my invention the workplace 131 is modified by the addition of a retractable stop or pin 133 movable vertically by an actuator 134. The pin 133 is normally retracted and is extended responsive to a signal generated by a proximity sensor 136. The proximity sensor 136 detects the movement of the sheet-like material over the workplace 131 to a position where the trailing edge of the sheet has passed the locator pin, and sends a signal to a controller 137 which may be a programmable computer. The controller 137 is operatively connected to the motor 92 and provides signals thereto to reverse the direction of the motor which causes the trailing edge of the sheet to move into abutment against the locator pin 133 which the controller 137 instructed to extend upon receipt of the signal from the proximity sensor. The motor drives the positioner carriage to firmly urge the sheet against the pin and may hold it in position, for example by means of a clutch mechanism interposed between the output shaft and the sprocket which allows the motor to hold the chain at a fixed position, while the sheet abuts the pin. While the sheet is held against the pin 133 the controller 137 directs the linear actuators 118 and 119 to urge the sheet laterally into engagement with the workholders 132, which are aligned as is well known in the art. In as much as the actuators are independent of each other, the sheet is urged laterally and may pivot as necessary to insure that the side of the sheet is aligned in the workholder 132. Sensors may be utilized to indicate proper registration in the workholder 132 as is well known which also cause the workholder to grip the sheet. Upon engagement of the sheet within the workholder, controller 137 directs the release of the vacuum from cup 123 and causes actuator 114 to raise the arm assembly. The positioner carriage may then return to its initial position to await the arrival of the next sheet from the transport device.

The turret press will perform its function and punch a pattern or plurality of patterns on the sheet, using as much of the sheet as possible. Of course, the margin to which the workholders are attached is not usable, however in many instances the remainder of the entire surface is usable. My positioner allows precise and rapid positioning which allows the sheet area to be used to its maximum extent without concern for improper positioning. Upon completion of the punch press processing the workholders urge the sheet in the first direction to travel toward a stacker apparatus, a preferred embodiment of which is shown in FIGS. 8–13.

Figure 8:
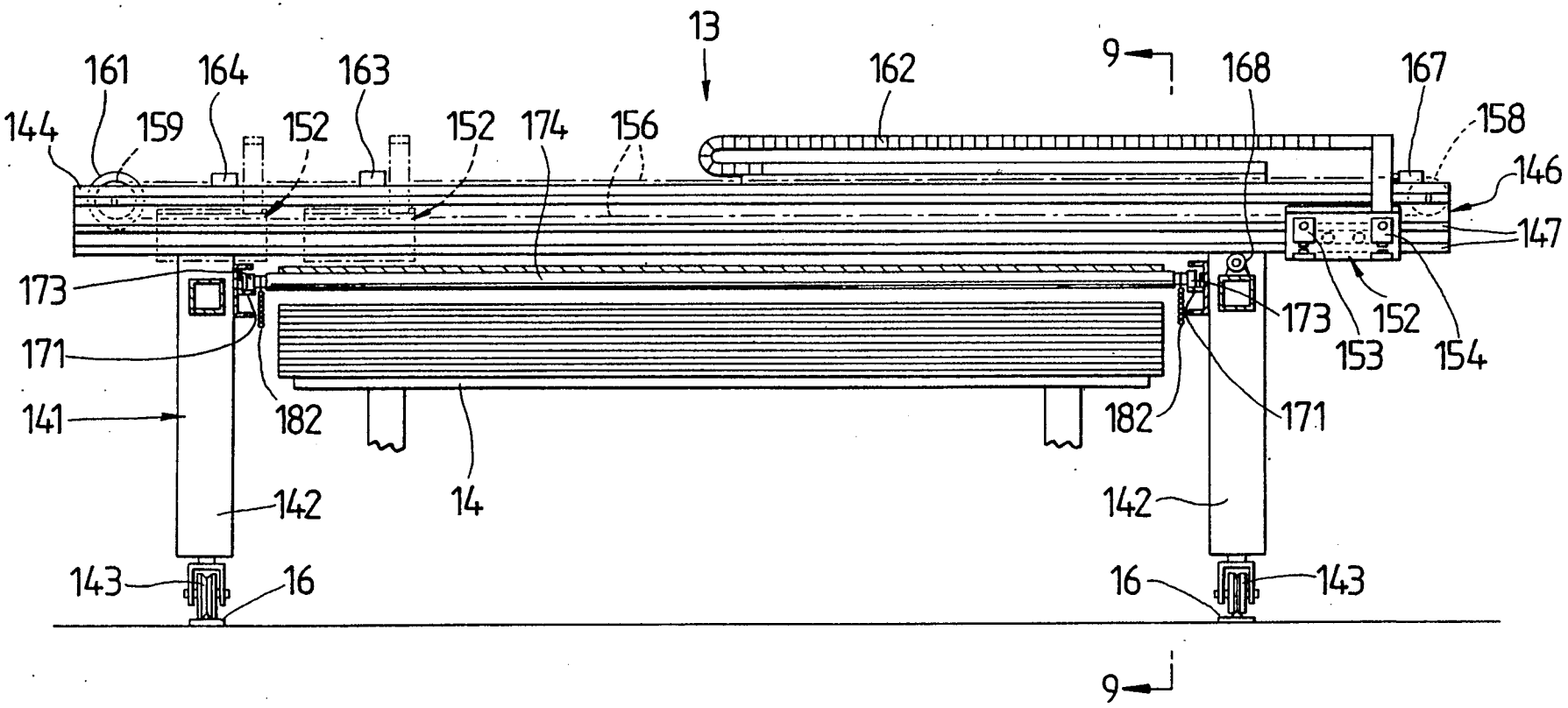
FIG. 8 is a front elevational view of the stacking apparatus.
Figure 10:
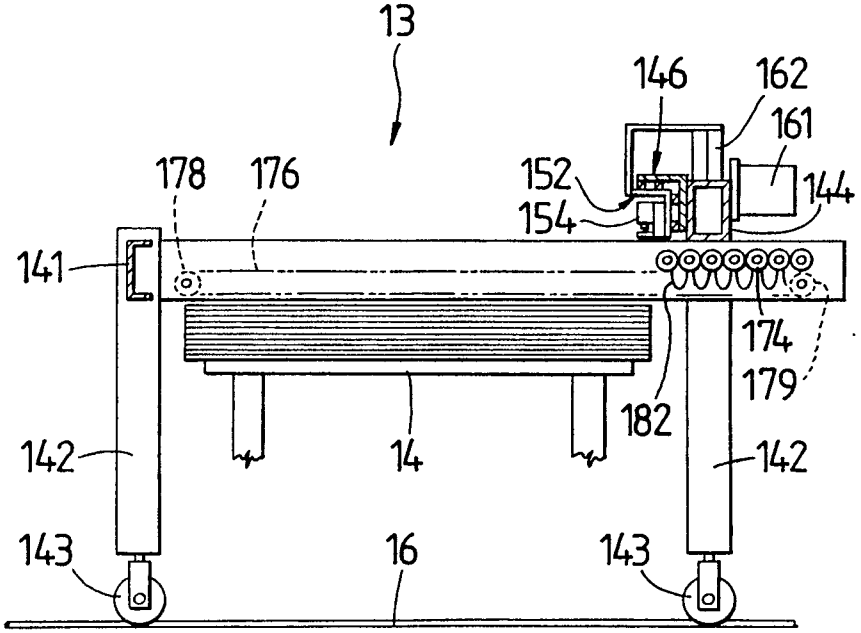
FIG. 10 is a sectional view of the stacker apparatus also taken along lines 9—9 of FIG. 8 showing the roller mechanism retracted.
Figure 9:
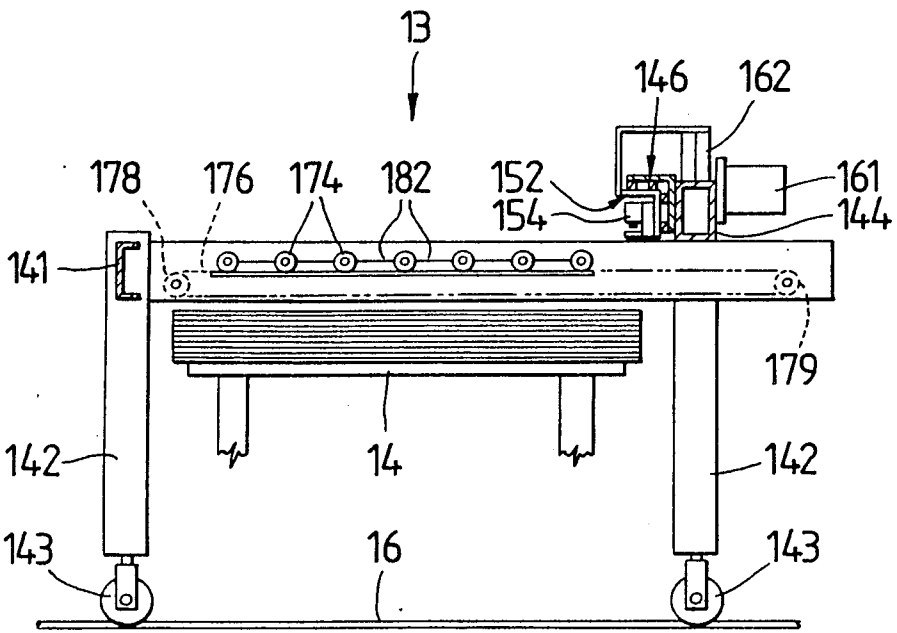
FIG. 9 is a sectional view of the stacker apparatus taken along line 9—9 of FIG. 8.
Figure 11:
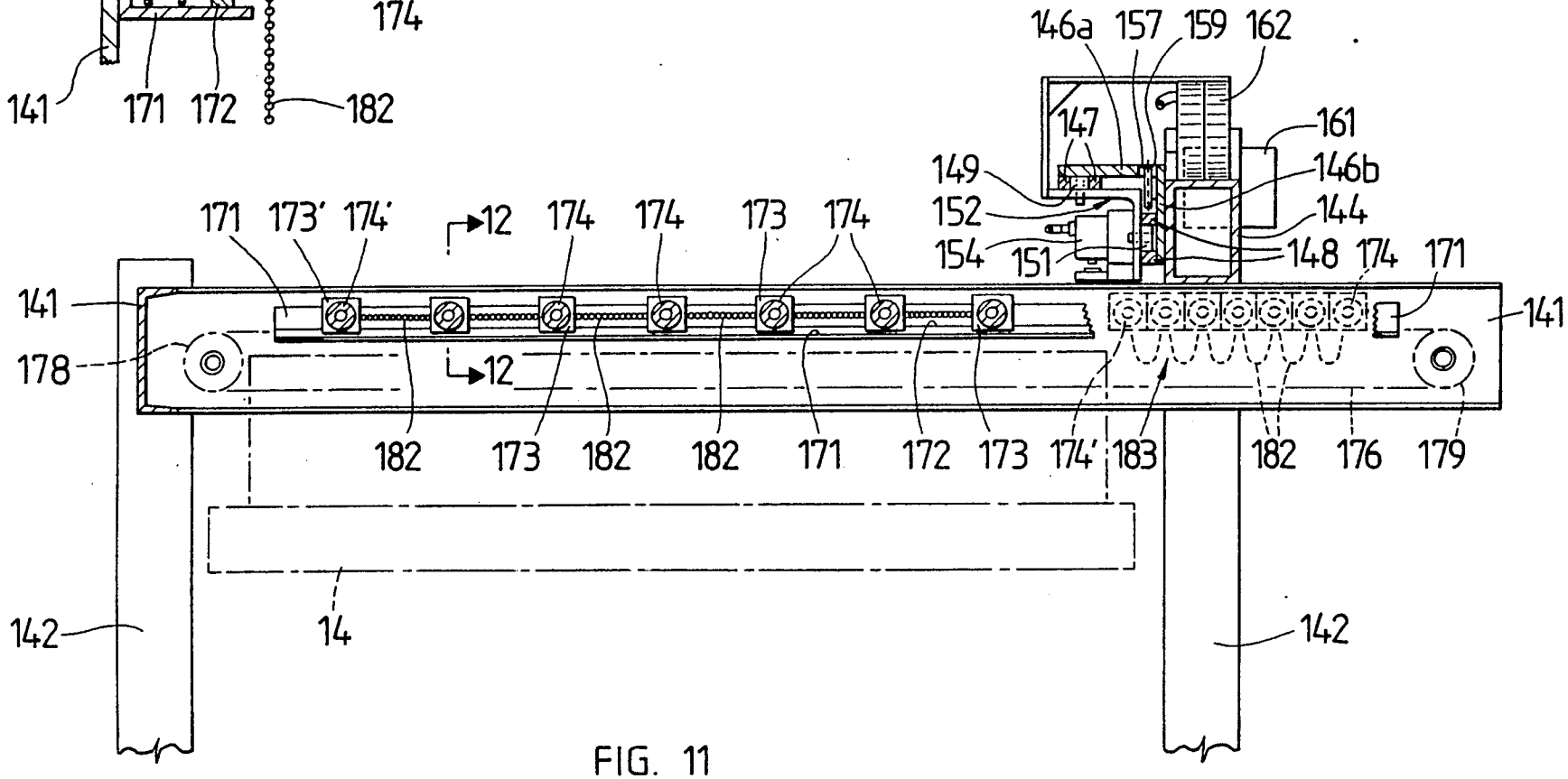
FIG. 11 is an enlarged sectional view of the stacker table.
Figure 12:
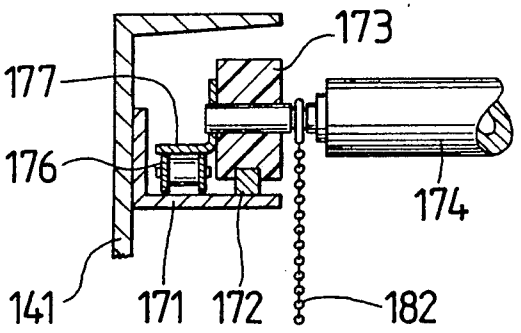
FIG. 12 is a detail sectional view taken along lines 12-12 of FIG. 11.
Figure 13:
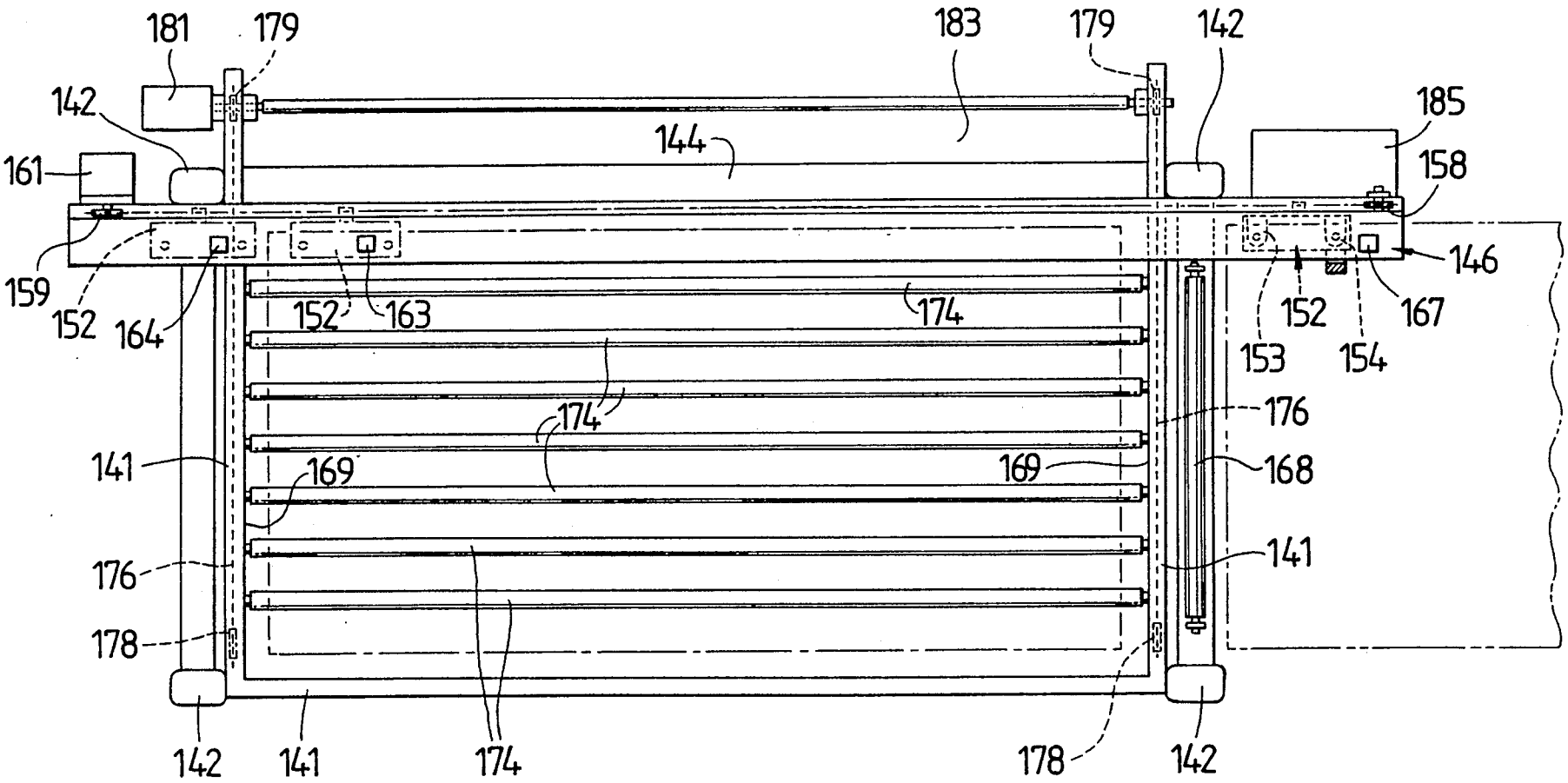
FIG. 13 is a plan view of the stacker.

As may be seen in FIG. 1 and 8 the stacker 13 is movably positioned on a set of rails 20 over a table 16. The stacker includes a frame assembly 141 with vertical support members 142 supported on said engaging rollers 143. A runway assembly 144 is mounted atop the frame assembly 141. As may be seen more clearly in FIG. 11 the runway assembly 144 includes a runway angle 146 which extends longitudinally in the direction of travel and which has a vertical leg 146*a* and a horizontal leg 146*b*. Each leg has mounted thereon a set of parallel rails 147 and 148. Each set of parallel rails receives therebetween a set of rollers 149 and 151 which carry and guide a carriage angle 152. The carriage angle 152 in turn supports a pair of spaced apart clamps 153 and 154 or workholders and is connected to a chain 156 which passes through a slot 157 in leg 146*b* and about an idler sprocket 158 and a drive sprocket 159 mounted on opposite ends of runway frame element 144. A variable direction motor 161 is provided to rotate drive sprocket 159. The clamps 153 and 154 are fluid actuated and connected to a source of fluid supply by flexible conduit 162 as is well known in the art. Limit switches 163, 164 and 166 are mounted to cooperatively engage the carriage angle 152 at various locations as more fully explained herein.

FIGS. 9–13 also illustrate the disappearing table mechanism of the stacker. An input roller 168 is mounted on the frame assembly 141, transversely of the direction of travel of the sheets of material. This roller 168 rotates about a fixed axis and provide transitional support to a sheet of material moving thereover. The disappearing table utilizes a set of guides 169, shown most clearly in FIGS. 9 and 13 which are mounted parallel to roller 168. As seen in greater detail in FIG. 12, the guides 169 include an angle 171 mounted to the frame assembly 141 with a track 172 attached to the upper surface of the angle 171. Supported for sliding movement on the track 172 are a plurality of roller blocks 173. Each roller block 173 acts as a bearing for a roller 174 extending parallel to the direction of travel of the sheets of material.

Note that a chain 176 is attached by a bracket 177 to the outermost roller block 173'. Chain 176 runs longitudinally about angle 171 and an idler sprocket 178 and a drive sprocket 179 displaced from the ends of angle 141. A reversible motor 181 rotates drive sprocket 179 to move chain 178 and roller block 173'. Roller block 173' and its associated roller 174' are attached to the remaining rollers 179 by a flexible chain 182, such that the rollers and blocks are sequentially extended and are retracted by the abutment of block 173' against the adjacent block 173. The rollers may be completely withdrawn into a cache 183 formed beneath the runway assembly 141.

In operation the clamps 153 and 154 receive the side of a sheet of material therein from the workholder of the processing station. As will be appreciated, the clamps 153 and 154 are the same type clamps as utilized by the workholder 132, thus they grip the sheet in the same marginal area. Consequently, the clamps 153 and 154 do not encounter any areas which were stamped by the press and a secure grip is insured. In contrast, clamping the forward edge of the sheet may result in clamping to a stamped area, thus the grip may be loose or non-existent. The use of two secure clamps which are held in fixed relation to each other by carriage angle 152 causes the sheet 49 to maintain its alignment as the carriage moves along the runway assembly 144. Note that upon receipt of the sheet within the clamps 153 and 154,the workholder 132 releases the sheet and the rollers 174 of the disappearing table are fully extended. As the stacker carriage draws the sheet over the roller 168 the sheet may move across the surface of rollers 174 until the trailing edge of the sheet rests atop the rollers 174. When the sheet is thus positioned on the disappearing table, the first limit switch 163 is encountered by the carriage angle 152 whereupon motor 161 is halted and motor 18 is actuated to retract block 173' and its roller. As block 173' and its rollers move from beneath the sheet, the edge of the sheet is lowered on to table 14 or previously delivered sheets stacked on table 14, in precise alignment with the stack position. Clamps 153 and 154 are opened and motor 161 is actuated to move the carriage angle 152 and clamps 153 and 154 away from the edge of the sheet until the angle encounters limit switch 164. This movement insures that the sheet will disengage the clamps 153 and 154 and come to rest atop the innermost rollers 174 which are about 1 inch below the clamps 153 and 154 and which will be subsequently removed from beneath the sheet. The motor 161 is reversed to return the carriage angle to its initial position which is indicated at limit switch 167. The block 173 and associated rollers 174 are retracted from beneath the sheet as the carriage is returned, thus the carriage need not wait for the sheet to clear the rollers for its return. Since the rollers offer little frictional resistance to the sheet, the sheet remains aligned in the stacking position as it is discharged. Upon complete retraction of the rollers, the motor 161 is reversed to extend the rollers to receive the next sheet. It should be understood that a controller 185 such as a programmable logic circuit may be employed to coordinate the interaction of the various components. In practice, the present stacker can achieve a cycle time of about 12 seconds whereas known prior art stackers have a cycle time of 45 to 60 seconds.

It is also noteworthy to mention that the controllers of each unit in this system may be interconnected with each other and with other apparatus such as the turret punch press to provide an automated and coordinated system which can achieve a very efficient and very high production rate.

While I have shown my invention in one form, it will be obvious to those skilled in the art that it is not so limited but is susceptible of various changes and modifications without departing from the spirit thereof.

What I claim is:

1. Apparatus for processing semi-rigid sheet-like members of various sizes, thicknesses, and flexibilities wherein said sheet-like members are initially stacked one atop another comprising:

(a) means for separating a top sheet-like member from a stack of sheet-like members supported on a vertically indexing loading table including a first and second set of vacuum gripping members selectively positioned in spaced horizontal relation and mounted for concomitant reciprocal horizontal movement and independent asynchronous vertical movement, and including transport means for urging said separated sheet-like member in a first horizontal direction coincident with the reciprocal horizontal movement of said vacuum-gripping members;

(b) means for positioning said sheet-like member on a workplace with said workplace having means for gripping said sheet-like member along one side thereof, said positioning means cooperatively positioned to receive said sheet-like member from said transport means and including means for aligning said sheet-like member in a predetermined orientation; and (c) means for stacking sheet-like members received from said workplace including means for urging said sheetlike member from said workplace to an aligned position above a stacking table including means for grasping said sheet-like member along said one side thereof; wherein said means for stacking said sheet-like material includes a frame disposed about said stacking table having an open top disposed horizontally at substantially the height of said work table; and a plurality of elongated roller members extending parallel to said first horizontal direction, and selectively movable laterally to an extended position extending over said open top and to a retracted position laterally of said open top, subjacent said means for grasping and said means for grasping being selectively movable parallel to said roller members to a sheet-like member receiving position and a sheet-like member releasing position distal said work table.

2. Apparatus as defined in claim wherein said means for grasping comprises:

(a) a first gripper element and a second gripper element, each of said gripper elements having a pair of opposing clamp members with at least one clamp member of each pair being selectively movable to an open or closed position, and with said gripper elements being aligned and spaced apart in a horizontal plane;

(b) a carriage member supporting said gripper elements and reciprocally movable parallel to said roller members between a receiving position and a discharge position; and (c) means for selectively driving said carriage member to said receiving position and said discharge position.

3. Apparatus as defined in claim 2 wherein said means for selectively driving comprises a hydraulic motor and a chain driven thereby and connected to said carriage member.

4. Apparatus as defined in claim 1 wherein said plurality of rollers include an outermost roller operatively connected to a means for selectively urging said roller to said extended position and to said retracted position, and a plurality of inner rollers connected to adjacent ones of said plurality of rollers by a flexible linkage such that said plurality of inner rollers move responsive to movement of said outermost roller.

5. Apparatus as defined in claim 1 further comprising means for sensing the presence of said gripping means at said sheet releasing position with said sensing means being operatively connected to actuate movement of said plurality of rollers from said extended position to said retracted position.

6. Apparatus for processing semi-rigid sheet-like members of various sizes, thicknesses, and flexibilities wherein said sheet-like members are initially stacked one atop another comprising:

(a) means for separating a top sheet-like member from a stack of sheet-like members supported on a vertically indexing loading table including a first and second set of vacuum gripping members selectively positioned in spaced horizontal relation and mounted for concomitant reciprocal horizontal movement in a first predetermined direction and independent asynchronous vertical movement, and including transport means for urging said separated sheet-like member in a first horizontal direction coincident with the reciprocal horizontal movement of said vacuum-gripping members;

(b) means for positioning said sheet-like member on a workplace with said workplace having means for gripping said sheet-like member along one side thereof, said positioning means cooperatively positioned to receive said sheet-like member from said transport means and including means for aligning said sheet-like member in a predetermined orientation; and (c) means for stacking sheet-like members received from said workplace including means for urging said sheetlike members received from said workplace to an aligned position above a stacking table including means for grasping said sheet-like member along said one side thereof; wherein said means for positioning includes at least two spaced apart surface engaging members spaced apart and independently movable vertically and horizontally transverses to said first predetermined direction;

carriage means for moving said surface engaging members reciprocally parallel to said first predetermined direction; and retractable stop means positioned at a fixed point on said workplate for aligning a trailing edge of a sheetlike member with said carriage means being operable to urge said trailing edge against said stop means and said surface engaging member being operable to urge said sheet-like member laterally for alignment on said workplace.

7. Apparatus as defined in claim 6 further comprising a frame assembly, positioned adjacent said workplace and including a carriage track extending parallel to said first direction of travel and supporting a means for driving said carriage means.

8. Apparatus as defined in claim 7 wherein said carriage means comprises:

(a) a base assembly supported on said carriage track and operatively connected to said driving means; and (b) means operatively connected to said base assembly and said surface engaging means for retracting said surface engaging means to an inoperative position.

9. Apparatus as defined in claim 8 wherein said surface engaging members are supported on a bridge assembly, said bridge assembly including a first and second arm member pivotally mounted at one end thereof to said base assembly and being interconnected by a spanning member, with each arm having a telescoping outer end movable to a selected position and said outer end each supporting a surface engaging member and a means for moving said surface engaging member perpendicular to said arm member.

10. Apparatus as defined in claim 9 wherein said surface engaging members comprise vacuum cups and said means for moving said surface engaging members comprise linear actuators.

11. Apparatus as defined in claim 10 wherein said retractable stop means comprises a retractable pin mounted in said work place, said pin being extendable responsive to means for sensing said trailing edge at a position proximal said retractable pin.

12. Apparatus as defined in claim 11 further comprising control means operatively connected to receive signals from said sensing means for coordinating the movement of said carriage means and said surface engaging members, whereby said carriage means moves in said first direction of travel upon engagement of said sheet-like members until said trailing edge is sensed by said sensing means, whereupon said carriage means urges said sheet-like member in an opposite direction to abut against said stop means and said surface engaging members urge said sheet-like member laterally into engagement with said work place gripping means.

13. Apparatus for processing semi-rigid sheet-like members of various sizes, thicknesses, and flexibilities wherein said sheet-like members are initially stacked one atop another comprising:

(a) means for separating a top sheet-like member from a stack of sheet-like members supported on a vertically indexing loading table including a first and second set of vacuum gripping members selectively positioned in spaced horizontal relation and mounted for concomitant reciprocal horizontal movement and independent asynchronous vertical movement, and including transport means for urging said separated sheet-like member in a first horizontal direction coincident with the reciprocal horizontal movement of said vacuum-gripping members, wherein said separating means includes:

(i) a frame positioned superjacent said loading table;

(ii) carriage means mounted on said frame for longitudinal movement thereon at an elevation above said stack;

(iii) first lift means supported on said carriage means for lifting said first set of vacuum gripping elements and sheet of material from said stack including a plurality of vacuum cups adapted for engagement with said uppermost sheet of material and means for varying the elevation of said vacuum elements; and (iv) second lift means for lifting said second set of vacuum gripping elements and said sheet-like material also supported on said carriage means and independently displaceable thereon from said first lift means, having a plurality of vacuum cups adapted for engagement with said uppermost sheet and means for varying the elevation of said vacuum elements, such that said cups of said second lift means are independently variable in elevation in relation to vacuum cups of said first lift means wherein said first lift means includes a plurality of guide elements running vertically from said carriage frame to an elevation above said carriage frame to an elevation above said stack;

a crossbeam assembly extending laterally between said plurality of guide elements and attached thereto;

a hydraulic cylinder disposed between said guide elements, extending vertically from said carriage frame and attached to said crossbeam;

a plurality of linear bearings attached under said crossbeam slidably supporting a linear guide rod assembly; and means for pivotally attaching said vacuum cups beneath said linear guide rod assembly;

(b) means for positioning said sheet-like member on a workplace with said workplace having means for gripping said sheet-like member along one side thereof, said positioning means cooperatively positioned to receive said sheet-like member from said transport means and including means for aligning said sheet-like member in a predetermined orientation; and (c) means for stacking sheet-like members received from said workplace including means for urging said sheetlike member from said workplace to an aligned position above a stacking table including means for grasping said sheet-like member along said one side thereof.

14. Apparatus for separating sheet materials as defined in claim 13 wherein said carriage means comprises a carriage frame supported by and movable along a first guide system extending longitudinally of said frame.

15. Apparatus as defined in claim 14 wherein said carriage means is selectively reciprocally propelled along said guide system.

16. Apparatus as defined in claim 13 wherein said second lift means is independently displaceable in linear relation to said first lift means by the combination of a motor and worm drive system extending longitudinally of said carriage frame in cooperation with a second guide system extending from said first lift means.

17. Apparatus as defined in claim 13 wherein said second lift means comprises:

(a) an auxiliary set of guide elements running vertically from second guide system to an elevation above said stack;

(b) a crossbeam assembly extending laterally between said auxiliary set of guide elements and attached thereto;

(c) a fluid cylinder disposed between said guide elements, extending vertically from an upper crossbeam and attached to said crossbeam;

(e) a plurality of linear bearings to attached to said crossbeam slidably supporting a linear guide rod assembly; and (f) means for pivotally mounting said vacuum cups beneath said linear guide rod assembly.

18. Apparatus as defined in claim 14 comprising a discharge means for removing said sheet from said apparatus wherein said transport means comprises a driven pinch roller for receiving said sheet-like member and urging said sheetlike member from said apparatus.

19. Apparatus as defined in claim 14 comprising control means for activating said first and second lift means and activating and limiting movement of said carriage means in timed sequence wherein an optical switch is activated when said carriage unit moves said sheet into said transport means, thereby causing said apparatus to return to its initial position and begin time controlled said separation procedures.

20. Apparatus as defined in claim 17 wherein said linear guide rod assembly comprises:

(a) a plurality of guide rods, each coaxially mounted with springs and urged against said linear bearings;

(b) a plurality of linear carriages, each depending from and supported by said guide rod;

(c) a crossmember extending laterally beneath and attached to said plurality of linear carriages and supporting said vacuum cups thereon.

* * * * *